United States Patent [19]

Takeuchi et al.

[11] 4,354,465

[45] Oct. 19, 1982

[54] DIESEL THROTTLE VALVE CONTROL SYSTEM

[75] Inventors: Koichi Takeuchi, Fujisawa; Teruo Nakada, Yokohama; Mitsuo Iwahara, Ebina, all of Japan

[73] Assignee: Isuzu Motors Ltd., Tokyo, Japan

[21] Appl. No.: 166,876

[22] Filed: Jul. 8, 1980

[51] Int. Cl.[3] ..... F02D 9/00

[52] U.S. Cl. ..... 123/339; 123/341; 123/389

[58] Field of Search ..... 123/376, 378, 389, 393, 123/339, 341, 403

[56] References Cited

U.S. PATENT DOCUMENTS 3,456,632 7/1969 Rhodes ..... 123/389
3,977,372 8/1976 Fernandez ..... 123/389 X

FOREIGN PATENT DOCUMENTS 904133 4/1972 Canada ..... 123/376
2733672 2/1978 Fed. Rep. of Germany ..... 123/389

*Primary Examiner*—William A. Cuchlinski, Jr.

*Attorney, Agent, or Firm*—Sughrue, Mion, Zinn, Macpeak & Seas

[57] ABSTRACT

An intake air throttle valve control system for a diesel engine which greatly reduces vibration and noise and rough engine running at idling speeds. A throttle valve is provided in an intake passage in series with the intake air manifold of the engine with the valve operated by a negative pressure responsive actuator. The negative pressure responsive actuator is coupled to a source of negative pressure through a series-connected arrangement of a water temperature sensing valve, a vacuum cut-off valve and a negative pressure control valve. The water temperature sensing valve operates to connect or disconnect the source of negative pressure to the actuator in response to the temperature of the engine coolant. The vacuum cut-off valve vents the connections to the actuator to the atmosphere in response to an engine operating parameter such as the exhaust manifold pressure, the pressure in an oil line of the engine, or an output voltage of a generator which varies in response to the engine speed. The negative pressure control valve introduces atmospheric pressure into the system in proportion to the magnitude of negative pressure in the intake manifold downstream of the throttle valve.

8 Claims, 4 Drawing Figures

DIESEL THROTTLE VALVE CONTROL SYSTEM

BACKGROUND OF THE INVENTION

The present invention relates to a pneumatic air intake throttle valve control device for a diesel engine for pneumatically controlling an intake throttle valve therein operated at engine idle speed.

Recently, diesel engine cars, in particular, passenger cars have become popular due to their economic advantages. However, vibration and noise produced by the diesel engine have been problematic. Particularly, at engine idle speed, torque fluctuations, that is, angular velocity variations during a single engine cycle, have been remarkably high in comparison with gasoline engines. This is one factor causing the large amounts of vibration and noise.

In view of the above noted defects, an object of the present invention is to provide an intake air throttle valve control device in which at idle speed or for no-load operation of the engine, the air intake is controlled while at the same time the amount of throttle opening is controlled in accordance with exhaust pressure, engine water temperature, intake pressure and the like.

SUMMARY OF THE INVENTION

This, as well as other objects of the invention, are met by an intake air throttle valve control system for a diesel engine having an intake manifold, an exhaust manifold and a throttle valve disposed in a casing connected to the intake manifold. A negative pressure responsive actuator is coupled to a control rod which operates the throttle valve. The actuator has an atmospheric pressure chamber and a negative pressure chamber partitioned by a diaphragm and a spring biasing the diaphragm away from the negative pressure chamber and towards the direction of opening the control valve. The negative pressure chamber of the actuator is coupled to an outlet port of an engine temperature sensing valve such as a water temperature sensing valve which opens and closes the passage to the negative pressure chamber in response to the temperature of the liquid coolant in the water jacket of the engine. The inlet port of the water temperature sensing valve is connected to the outlet port of a vacuum cut-off valve which vents an outlet port thereof to the atmosphere in response to a predetermined engine parameter such as the pressure in the exhaust manifold or the pressure in an oil line of the engine. The vacuum cut-off valve may be a pneumatically-operated valve or a three-way electromagnetic valve. In the latter case, the valve can be operated by the output of a generator, the output voltage of which varies in response to the engine speed. The inlet port of the vacuum cut-off valve is coupled to the outlet port of a negative pressure control valve the inlet port of which is connected to a source of negative pressure. The negative pressure control valve is preferably a pneumatic valve which is operated in response to a pressure in the intake manifold at a point downstream of the throttle valve. The negative pressure control valve introduces atmospheric air into an outlet port thereof in proportion to the magnitude of the negative pressure in the intake manifold.

DESCRIPTION OF THE PREFERRED EMBODIMENTS

Figure 1:
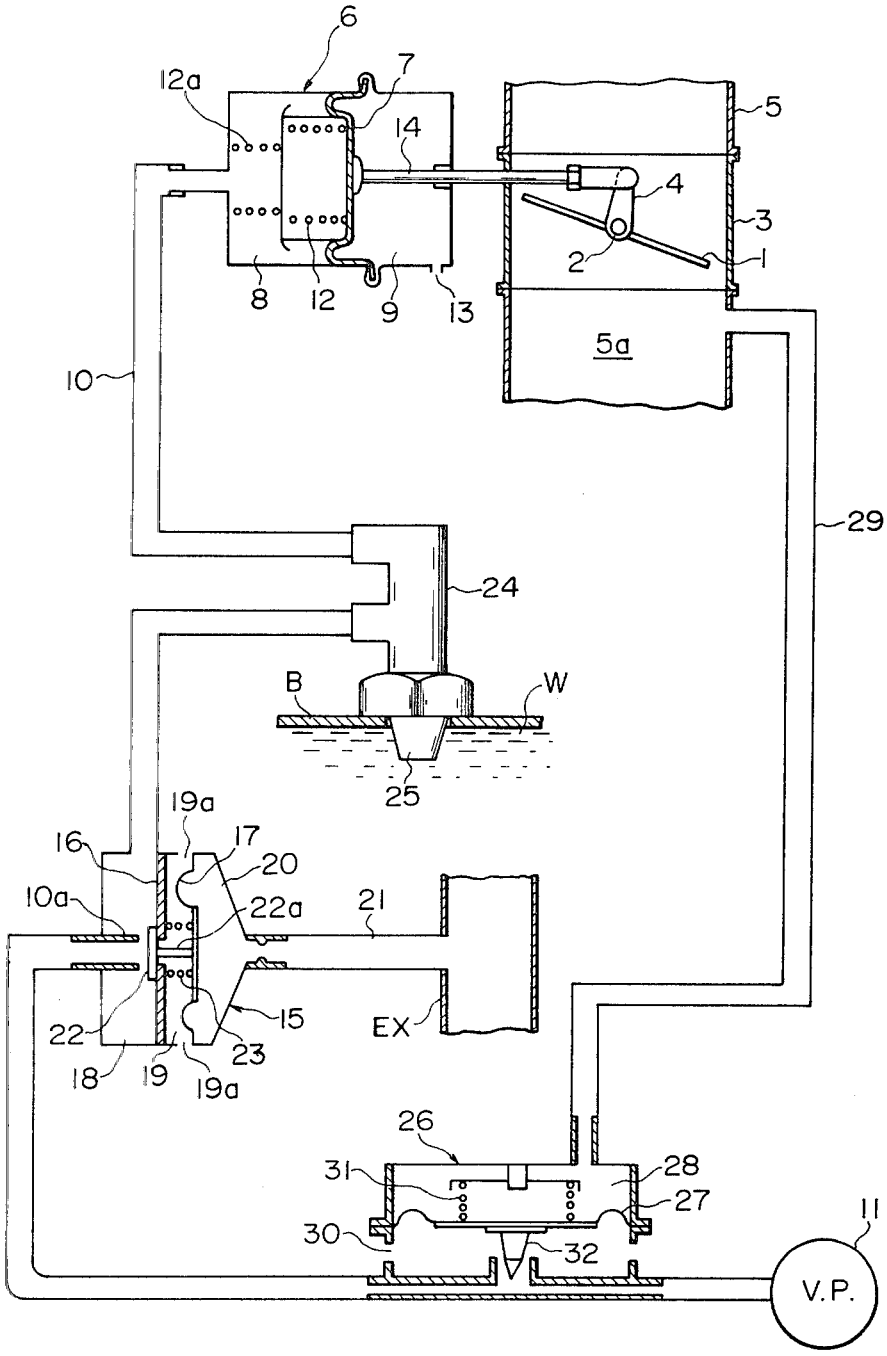
FIG. 1 is a diagram, partially as a cross-sectional view, of an intake air throttle valve control system constructed in accordance with the invention.

A diesel engine system constructed according to the present invention will now be described with reference to FIG. 1. An air intake throttle valve 1 is rigidly coupled to a shaft 2 which is rotatably supported by a casing 3. An arm 4 is attached thereto at one end for rotating the throttle valve 1 in a well known manner. The casing 3 for the throttle valve forms part of an intake passage 5 of the engine.

A negative pressure responsive actuator 6 is divided into a negative pressure chamber 8 and an atmospheric pressure chamber 9 by a diaphragm 7. The negative pressure chamber 8 communicates with a vacuum pump 11 through a tube 10. Compression springs 12 and **12*a* are interposed inside of the negative pressure chamber 8 biasing the diaphragm 7 rightward. A through-hole 13 is provided in the atmospheric pressure chamber 9 through which the atmospheric pressure chamber 9 is vented to the atmosphere. A rod 14 is connected at one end to the diaphragm 7 and at the other end to the arm 4** directly or through a suitable rod or link.

A vacuum cut-off valve 15 is divided into a negative pressure chamber 18, an atmospheric pressure chamber 19 and a pressure chamber 20 by a partitioning plate 16 and a diaphragm 17. The pressure chamber 20 communicates with an exhaust passage EX (partially shown) through a tube 21 so as to detect the exhaust pressure in the exhaust passage. A valve body 22 is attached to one end of a valve stem **22*a* so that the valve body 22 is operative to close an opening 10*a* of the tube 10 against a spring force of a spring 23** when a predetermined exhaust pressure is applied to the diaphragm.

A water temperature sensitive valve 24 is disposed between the vacuum cut-off valve and the actuator. A water temperature sensing element 25 is disposed in a water jacket of an engine body B so that an internal passage (not shown) through the element is closed or opened in response to operation of the temperature sensing element 25.

A negative pressure control valve 26 is interposed between the vacuum pump 11 and the vacuum cut-off valve 15. A negative pressure chamber 28 of the negative pressure control valve 26 is divided by a diaphragm 27 and is connected to a downstream side **5*a* of the intake air throttle valve 1 to detect a negative intake charge pressure downstream of the throttle valve 1 and to thereby operate the diaphragm 27 against the force of a spring 31. A conical valve body 32 is carried by the diaphragm 27 which moves together therewith to control the amount of air flow into the tube 10**.

In the operation of the thus constructed control system according to the present invention, at idle speed with warm ambient conditions until the exhaust pressure of the exhaust passage EX reaches a predetermined value, the valve body 22 of the valve 15 is inoperative at the position shown in FIG. 1 while at the same time the water temperature sensing valve 24 opens the inside passage thereof. In this case, by the action of the vacuum pump 11 the diaphragm 7 of the actuator 6 is moved leftwardly against the force of springs 12 and 12*a* due to the negative pressure in the negative pressure chamber 8 and the rod 14 is also moved leftwardly. Accordingly, the intake air throttle valve 1 is rotated counterclockwise by the arm 4 whereby the air charge or air flow amount through the intake passage 5 is reduced or throttled. Thus, as the amount of intake air is decreased, angular velocity fluctuation and the vibromotive acceleration of the engine are reduced thereby decreasing the vibration and noise of the engine at idle speed. Also, because of the reduction of vibration and noise of the engine, vibration of the vehicle body and shift lever are reduced.

When the negative intake pressure downstream of the intake air throttle valve 1 is excessively increased, the valve body 32 of the negative pressure control valve 26 is lifted upwardly against the force of the spring 31 with the amount of movement dependent on the magnitude of the negative pressure. Since the atmospheric air is introduced into the tube 10 through the control valve 26 in response to the magnitude of the negative pressure, the actuator 6 operates to maintain substantially constant the negative intake pressure at a portion of the passage downstream of the intake air throttle valve. For this reason, the intake pressure is not excessively throttled by the intake air throttle valve 1.

With idling conditions in cold ambient conditions, although the vacuum cut-off valve 15 is open, the water temperature detecting valve 24 closes the internal passage until a predetermined temperature is reached. Accordingly, the actuator 6 is inoperative and the intake air throttle valve 1 is maintained in the fully opened position.

Further, regardless of the ambient temperature, when the engine is running not at the idle speed but at a normal operational speed, the exhaust pressure increases and a high pressure is applied to the pressure chamber 20 of the valve 15. In this case, the diaphragm 17 and the valve body 22 integral therewith are moved leftward against the spring 23 to thereby close the opening 10*a* of the pipe 10 and introduce atmospheric pressure through holes 19*a* to the negative pressure chamber 8 of the actuator 6. The intake air throttle valve 1 is then returned to the fully opened position and hence there is then no throttling effect on the intake passage 5. As mentioned above, according to the invention, at the normal operational speed of the engine, engine performance problems such as a reduction of the engine output power are not present.

Figure 2:
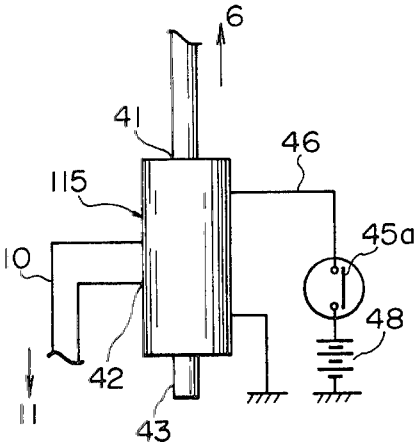
FIG. 2 is a diagram showing an alternative arrangement of a vacuum cut-off valve utilized in the embodiment of FIG. 1.

FIG. 2 shows a second embodiment of a vacuum cut-off valve 115 having the same effect as in the vacuum cut-off valve designated by 15 in FIG. 1, according to the present invention. In FIG. 2, valve 115 is a three-way electromagnetic valve having an inlet port 42 for introducing negative pressure, an outlet port 41 and an atmospheric venting port 43. The three-way valve 115 is connected to the system in the same manner as in the foregoing embodiment. The three-way valve 115 is so constructed that the outlet port 41 can be selectively connected to or disconnected from the inlet port 42 or the release port 43 by a control valve operating member within the valve 115. A hydraulic pressure detecting switch 45 detects the hydraulic pressure of an oil line of the engine and in response thereto operates the three-way valve 115. In this embodiment, a contact point 45*a* of the switch is opened at engine idle speed at which time the engine oil pressure is low whereas the contact point is closed to operate the magnetic valve 115 when the engine speed is above a predetermined value. The switch 45 is connected at one end to the magnetic valve 115 through a wire 46 and at the other end to a battery 48.

The operation of the overall system using a magnetic valve for valve 115 instead of a pneumatic cut-off valve is believed clear from the foregoing description. At the engine idle speed, the hydraulic pressure in the oil line is low. Until a predetermined pressure is reached, the detecting switch 45 remains inoperative. Accordingly, since the negative pressure derived from the vacuum pump 11 is applied to the negative pressure chamber 8 of the actuator 6 through the magnetic valve 115, a throttling effect to the passage 5*a* is provided as mentioned above. At normal engine running speeds except for idle speed, the oil pressure increases thereby closing the detecting switch 45 and venting the valve 115 to the atmosphere. The same effects are obtained as in the first-described embodiment.

The closing or opening operation of the hydraulic pressure detecting switch 45 may be reversed from that described above. In this case, the operation of the magnetic valve 115 must be reversed. Also in the above-described embodiment, the oil pressure of the engine is used as the controlling parameter although the exhaust gas pressure of the engine can be used as well for the parameter representative of the engine running condition.

Figure 3:
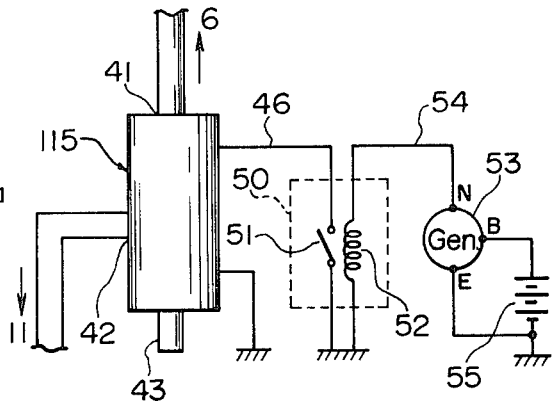
FIG. 3 is a further alternative embodiment of the vacuum cut-off valve of the embodiment of FIG. 1.

FIG. 3 shows still another embodiment of the valve 115 according to the present invention. In this embodiment, the valve 115 is also a three-way electromagnetic valve connected in line with the tube 10. The magnetic valve has a negative pressure outlet port 41, a negative pressure inlet port 42 and an atmosphere venting port 43 which are connected in the system in the same manner as the embodiment of FIG. 2. The outlet port 41 is selectively connected to the inlet port 42 or the atmosphere venting port 43 by a suitable control valve operating member within the valve 115. A relay 50 is provided in which a contact 51 is closed by energization of a relay coil 52. The relay 50 is connected to the valve 115 through a line 46. The relay coil 52 is connected through a wire 54 to an N-terminal of an electric generator 53 which is driven by the engine. As the engine speed increases, the output voltage from the generator 53 increases energizing the relay coil 52. The terminals B and E of the generator 53 are connected to a battery 55 as shown.

At idle speed, the output voltage from the generator 53 is sufficiently low that the relay coil 52 is inoperative and the contact point 51 is open. As the water temperature detecting valve 24 is also open, negative pressure derived from the vacuum pump 11 is supplied to the negative chamber 8 of the actuator 6 through the magnetic valve 115. Regardless of the ambient temperature, for normal engine running conditions, since the generated voltage is increased, the relay coil 52 is energized thereby closing the contact 51. Accordingly, by the action of the magnetic valve 115, communication between the outlet ports 41 and the inlet port 42 is prevented and outlet port 41 is vented to the atmosphere through the port 43. The subsequent operation is the same as in the foregoing.

Figure 4:
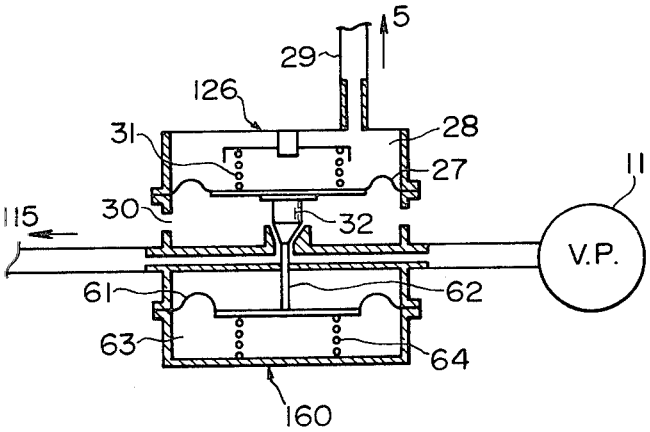
FIG. 4 shows a modification of a negative pressure control valve used in the embodiment of FIG. 1.

FIG. 4 shows another modification of the negative pressure control valve for the system, in which a negative pressure control valve 126 is constructed as shown in FIG. 1 but there is provided an atmospheric pressure compensation device 160 disposed beneath the negative pressure control valve 126. The atmospheric pressure compensation device 160 is provided with a constant pressure chamber 63 for maintaining an inner pressure therein substantially at the sea-level atmospheric pressure. A diaphragm 61 partitioning the constant pressure chamber 63 from the atmospheric pressure chamber 30 is connected to the above described valve body 32 through a rod 62. A return spring 64 biases the diaphragm 61 upwards.

With the use of such an atmospheric pressure compensation device, at normal idle speed in a low altitude district, the system operates in the same manner as described above because the pressure in the constant pressure chamber is offset by the normal atmospheric pressure in the chamber 30. If the vehicle is run in a high altitude district, since the atmospheric pressure is then lowered, the magnitude of the negative pressure in the intake air passage is correspondingly increased so that the throttling effect provided by the intake air throttle valve 1 is increased. However, if the above-described compensation device is used, since the decrease of atmospheric pressure due to a change in altitude in the atmospheric chamber 30 is compensated for by the constant pressure chamber 63 disposed below the chamber 30, excessive expansion of the negative pressure chamber 28 defined by the diaphragm 27 and valve body 32 due to the increased negative pressure is prevented. Thus, an atmospheric pressure decrease due to operation in a high altitude district is well compensated for and the excessive throttling due to atmospheric pressure change is prevented.

What is claimed is:

1. An intake air throttle valve control system for a diesel engine having an intake manifold and an exhaust manifold comprising:

a throttle valve disposed to control the flow of air in said intake manifold, said throttle valve having a control rod coupled thereto;

a source of negative pressure;

a pressure responsive actuator coupled to said control rod to operate said throttle valve, said actuator having an atmospheric pressure chamber and a negative pressure chamber, a diaphragm separating said atmospheric pressure chamber and said negative pressure chamber, and spring means biasing said diaphragm towards said atmospheric pressure chamber;

an engine temperature sensing valve means having inlet and outlet ports, said engine temperature sensing valve means being operatively positioned to operate in response to the engine temperature, said outlet port of said engine temperature sensing valve means being in fluid communication with said negative pressure chamber of said actuator;

a vacuum cut-off valve having inlet and outlet ports, said outlet port of said vacuum cut-off valve being in fluid communication with said inlet port of said engine temperature sensing valve means, said vacuum cut-off valve venting an outlet portion thereof to the atmosphere in response to a predetermined engine operational parameter;

a negative pressure control valve having an inlet port and an outlet port, said outlet port of said negative pressure control valve being in fluid communication with said inlet port of said vacuum cut-off valve and said inlet port being coupled to said source of negative pressure, said negative pressure control valve operating in response to a pressure in said intake manifold at a point downstream of said throttle valve, and said negative pressure control valve introducing atmospheric air into an outlet port thereof in an amount in proportion to the magnitude of negative pressure at said point downstream of said throttle valve in said intake manifold.

2. The intake air throttle valve control system of claim 1 wherein said vacuum cut-off valve has a negative pressure chamber, an atmospheric pressure chamber and a pressure chamber in fluid communication with said exhaust manifold, a diaphragm dividing said atmospheric pressure chamber from said pressure chamber in fluid communication with said exhaust manifold, a partitioning plate dividing said atmospheric pressure chamber from said negative pressure chamber, said partitioning plate having an aperture therethrough, a rod coupled to move with said diaphragm, a valve body disposed within said negative pressure chamber and operatively coupled to said rod movable in response to a magnitude of the exhaust negative pressure, and a spring biasing said diaphragm away from said partitioning plate.

3. The intake air throttle valve control system of claim 1 wherein said vacuum cut-off valve operates in response to the pressure in an oil line of said engine.

4. The intake air throttle valve control system of claim 1 wherein said vacuum cut-off valve comprises a three-way electromagnetic valve having an inlet port, an outlet port and an atmospheric venting port and means for operating said three-way electromagnetic valve in response to said parameter.

5. The intake air throttle valve control system of claim 4 wherein said operating means comprises an electrical switch connected to be operated in response to the pressure in an oil line of said engine.

6. The intake air throttle valve control system of claim 4 wherein said operating means comprises an electrical generator operatively coupled to said engine, said electrical generator producing an output voltage which varies in response to the speed of rotation of said engine.

7. The intake air throttle valve control system of claim 1 further comprising a water jacket, wherein said engine temperature sensing valve means includes a water temperature sensing valve for sensing the water temperature in said water jacket.

8. The intake air throttle valve control system of any of claims 1–7 further comprising pneumatic compensation means having a constant pressure chamber at a pressure substantially equal to sea-level atmospheric pressure operatively coupled to said negative pressure control valve.

* * * * *